United States Patent [19]

Horn et al.

[11] 4,336,743

[45] Jun. 29, 1982

[54] GUN MOUNT FOR LIGHT AUTOMATIC WEAPONS

[75] Inventors: Kurt Horn, Oberndorf; Walter Müller, Rötenberg; Adolf Schneider, Altoberndorf, all of Fed. Rep. of Germany

[73] Assignee: Heckler & Koch GmbH, Oberndorf, Fed. Rep. of Germany

[21] Appl. No.: 110,909

[22] Filed: Jan. 10, 1980

[30] Foreign Application Priority Data

Jan. 26, 1979 [DE] Fed. Rep. of Germany ..... 2902992

[51] Int. Cl.[3] ..... F41F 21/14

[52] U.S. Cl. ..... 89/37 B; 89/37 H; 89/41 C; 89/41 E

[58] Field of Search ..... 89/36 H, 36 K, 37 R, 89/37 A, 37 B, 40 B, 41 E

[56] References Cited

U.S. PATENT DOCUMENTS 3,424,052 1/1969 Ruf ..... 89/37 R

FOREIGN PATENT DOCUMENTS 742421 3/1933 France ..... 89/40 B 1234832 10/1960 France ..... 89/41 E

*Primary Examiner*—Stephen C. Bentley

[57] ABSTRACT

A gun mount for light automatic weapons, comprising an upper mount having cradle means for the detachable attachment of the weapon thereto and a lower mount having a circular track and being adapted to be attached to a vehicle in such a manner that the upper mount is rotated about the vertical axis of the circular track. The cradle is pivotable about a horizontal weapon traverse axis. Aiming means comprising a rigid periscope having fixed reflecting mirrors is provided with its eyepiece located below the circular track and whose sight radius is coupled with the traverse motion of the weapon about the weapon traverse axis. The aiming means is about a sight axis which is parallel to the horizontal weapon traverse axis and is attached to a blinder having surface areas which are rotationally symmetrical to the sight axis. A connecting rod is provided having one end pivotable about a first traverse axle parallel to the sight axis and is rigidly connected to the blinder and the other end of the connecting rod is articulated about a second traverse axle on said cradle. The sight axis, the weaspon traverse axis, the first traverse axle and the second traverse axle form the corners of a parallelogram.

17 Claims, 7 Drawing Figures

GUN MOUNT FOR LIGHT AUTOMATIC WEAPONS

The present invention relates to a gun mount for light automatic weapons.

In a known gun mount (rear gun mount of the "Marder" tank, "Soldat und Technik," June, 1971, page 332), the weapon is attached to a recoil-motion slide, which is mounted on a cradle which, in turn, is mounted in two bearing pedestals, welded to the top plate of the gun mount, in such a manner that it can be pivoted about a horizontal axis. An aiming periscope with two corner mirrors is provided; the upper corner mirror is coupled with the elevation/depression lever by means of linkage which can be adjusted for elevation and depression. However consequently the fabrication costs for the entire arrangement are relatively high, as transmission of the elevation or depression from the elevation/depression setting lever to the corner mirror must be highly precise, as only the most minor angular error could result in a significant variance between the sight radius and the barrel axis, thereby greatly reducing the accuracy. In order to be able to employ a weapon attached to a gun mount of this nature for both ground targets and antiaircraft applications, the depression range must amount to approx. 15° and the elevation range to at least 50°. However a difficulty in connection with antiaircraft applications, in which the target moves very quickly while it is within the range of the weapon, is that the possible field of observation is highly limited by the aiming means. When combatting air targets, it is therefore customary not to use overhead gun mounts, with which the gunner is located beneath the weapon, but freely aimable gun mounts, with which, while the head and shoulders of the gunner are not protected by armour, the gunner does have an unobstructed view of the situation, and wherein he can move more freely and can manipulate the weapon more quickly. This is of decisive significance in the case of rapidly moving targets.

A freely aimable gun mount of this nature, which permits a rapidly moving target to be tracked with the weapon, is known from German published patent application No. 2,064,133, for example.

It is the object of the present invention to improve a gun mount of the type mentioned at the outset in such a manner as to significantly reduce the cost and effort of fabricating the aiming means, on the one hand, while producing a large field of vision with the greatest possible mobility of the weapon, on the other.

SUMMARY OF THE PRESENT INVENTION

According to the present invention, a gun mount is provided comprising an upper mount having cradle means for detachable attachment of the weapon and a lower mount with a circular track attachable to a vehicle such that the upper mount is rotated about the vertical axis of the circular track together with the weapon. The cradle is pivoted about a horizontal weapon traverse axle. A cylinder blinder having aiming means is mounted so that the sight radius is coupled with the traverse motion of the weapon about the weapon traverse axle. The aiming means is designed as an inherently rigid periscope unit with fixed reflecting mirrors and can be tilted about a sight axle which is parallel to the horizontal weapon traverse axle. The aiming means is attached to a blinder having a surface area which is rotationally symmetrical to the sight axle. A further traverse axle, which is parallel to the sight axle, is rigidly connected with the blinder and can be tilted about a connecting rod whose other end is articulated to the weapon and/or to the weapon carrier. The sight axle, the weapon traverse axle, the further axle and the connecting rod articulation form the corners of a parallelogram.

As a result of the parallelogram arrangement of the above-mentioned axles and the fact that the periscope arrangement can be moved together with the blinder, precise coupling of the sight radius with the barrel axis of the weapon is achieved with a minimum of effort and expense, and without significantly reducing the mobility and movability of the weapon. Stationary, rigid reflecting mirrors can be employed, without the need for mechanical transmission means which are inaccurate and susceptible to defects.

In a preferred embodiment of the invention, at least one end of the connecting rod is attached in an easily detachable manner, the upper mount is arranged eccentrically to the circular track and is equipped with a hatch within the circular track. This embodiment provides the advantage that after opening the hatch, the connecting rod can be easily detached and the gun mount can be employed in the same manner as the known gun mount according to German published patent application No. 2,064,133. In this operating mode, air targets can be combatted much better and more effectively than with an overhead gun mount. The eccentric arrangement of the upper mount relative to the circular track provides space for the hatch. The gunner can be comfortably positioned in this space since through the employment of a gun mount according to German published patent application No. 2,064,133, the weapon ends in the area of the weapon traverse axle and no parts of either the weapon carrier or the weapon itself project to the rear beyond the weapon traverse axle.

The blinder carrying the aiming means can be designed in various manner. For example, it can be of quadrant configuration. In a preferred embodiment of the invention, however, the blinder is designed as a cylinder blinder having a configuration of a cylindrical segment. In this case, the horizontal sight radius and the axis of the cylinder coincide. Preferably, the aiming means, and the periscope of the aiming means, are attached to the blinder in such a manner that they can be easily attached or detached from the interior of the vehicle.

Aiming marks, e.g. crosshairs, etc., can be provided within the aiming means. An especially rugged embodiment is obtained if, according to a preferred embodiment of the invention, a rear sight is attached in the aiming means in front of the eyepiece and a front sight in front of the other end of the aiming means. This, primarily, also provides the advantage that it is not necessary for the gunner to reaccustom himself if the front and rear sights are designed in the same manner as the weapon's own sights. Since the rear sight is easily accessible from within the interior of the vehicle, it can, in a further embodiment, be adjustable and capable of being set for various ranges.

Preferably, the cylinder blinder is arranged relative to the other parts of the gun mount in such a manner that in its lowest position, the cylinder blinder is generally flush with the surface of the lower mount. This provides the advantage that it is largely protected against ground fire in its lowest position.

The cylinder blinder can be cast of armour plate, for example, in order to achieve the desired resistance to fire, even when being fired at with hard-core ammunition. In a preferred embodiment of the invention, however, the cylinder blinder comprises an inner body of aluminium alloy or a similar material and a jacket, as well as end plates if desired, of rolled armour plate. This embodiment not only provides the advantage of lighter weight, but also the advantage of higher serviceability under fire, since, if fired at with hard-core ammunition, the rolled armour plate bulges less than cast armour plate. This characteristic is especially pronounced in a preferred embodiment, in which the jacket is arranged at a distance from the inner body and/or those surfaces of the inner body facing the jacket preferably have pocket like depressions or chambers. Consequently, the jacket is slightly resilient and can deform inwardly, thereby avoiding bulges at the rim of the bullet hole, thereby largely eliminating any possibility of the blinder jamming relative to the opposite portion of the lower mount, having a minor gap (as a result of the seal against lead splatter). Thus, this design not only achieves a weight reduction, which is always desirable, but also improves the serviceability under fire, even when hard-core ammunition is being employed.

When weapons are employed in overhead gun mounts, it is frequently necessary to set the mode, e.g. single fire, bursts, sustained automatic fire, by means of an additional actuation element if operation of the weapon from within the vehicle is to remain unimpaired. In a preferred embodiment of the gun mount, a weapon is employed whose functions can be set by means of the length of trigger travel. In a preferred embodiment, a remote-control trigger is provided with adjustable travel limiters, thereby permitting the desired functions to be set at any time, without any additional cost or effort for operating and transmission elements.

Light automatic weapons are also employed for police service. However in police service, the use of weapons is always only the ultimate force to be used. Frequently, additional equipment is also required and must either be carried or mounted in or on the vehicle, e.g. loudspeakers, rotating beacons, floodlights, spot lights, flashing lights, tear gas devices, etc. However mounting these devices on the vehicle impairs the serviceability of the mounted weapon, as they frequently protrude into the possible field of fire. In a preferred embodiment of the gun mount according to the present invention, which can also be employed for police service, this problem is solved in that accessories, such as loudspeakers, sirens, etc., are mounted on the weapon carrier. Consequently, these devices are located at the highest point on the vehicle, on the one hand, thereby making them very effective, while ensuring, on the other hand, that they are entirely outside the field of fire and can neither hinder nor be damaged when the weapon is employed. In a preferred further development, these accessories are therefore attached to a protective hood, with power being supplied to them from the interior of the vehicle by means of travelling cables. This embodiment is especially advantageous if the protective hood can be easily removed in order to permit easy conversion for military service conditions, e.g. antiaircraft applications.

Power supply for rotatably arranged equipment is frequently somewhat problematic, as the rotational angle is either highly limitated as a result of roll-up cable reels or loop rings must be employed which, on the one hand, necessitate a high degree of cost and, on the other, are highly susceptible to defects. Moreover, AF and HF currents can frequently not be transmitted sufficiently clearly by means of loop rings, as their transmission quality declines significantly and quickly over the course of time. In a preferred embodiment of the invention, the cables are therefore run around the circular track and spring wound, with one stop each being provided for limiting the rotation of the circular track to ±approx. 180°. This therefore provides a full 360° of rotation, without any dead angles. On the other hand, the cable permits dependable, interference-free transmission of the feed current for lights, as well as both AF and HF currents, e.g. for the antenna of a radio communication unit, which can also be attached as an accessory.

The stops can be designed in various, known manners. In a preferred embodiment of the invention, they are attached to the circular track and operate conjointly with stationary stop pins. Preferably, the stop has three engagement positions, being pivoted into an outer engagement position when it comes into a contacting relationship with the first stop pin; in this position, it operates conjointly with the second stop pin to block the travel. When moved backward, it is pivoted back into the center engagement position again by the first stop pin. The stop pins are arranged in such a manner that, in each case, the first stop pin is arranged at the end of the ±180° traverse range and the second stop pin permits a certain degree of further traverse, e.g. limited to 15° to 30°. Thus, after passing the free traverse range of ±180°, for example, the gunner feels a noticeable stop engagement, which he can overrun if necessary, until arriving at the second stop pin. Thus, on the one hand, all requirements of practical service are taken into consideration, while permitting troublefree power supply via cables on the other. Each cable is run around the circular track, with the end of the cable freed by the rotation of the circular track being wound onto a spring-driven reel or wound off when the circular track is rotated in the other direction.

In preferred embodiments of the invention, the hood also covers the weapon laterally. In this case, the vertical front panel is preferably equipped with a trap door, operated from the inside, in a bulge in the hatch cover; through the trap door, the weapon's magazine can be changed by the gunner from the interior of the vehicle.

The above discussed and other objects, features, advantages and embodiments of the present invention will become more apparent from the following description thereof, when taken in connection with the practical example shown in the accompanying drawings, showing a simplified schematic representation, with details which are not of significance or necessary for understanding the invention having been omitted. The features contained in the description and drawings may be employed in other embodiments individually or in any desired combination.

Figure 3:
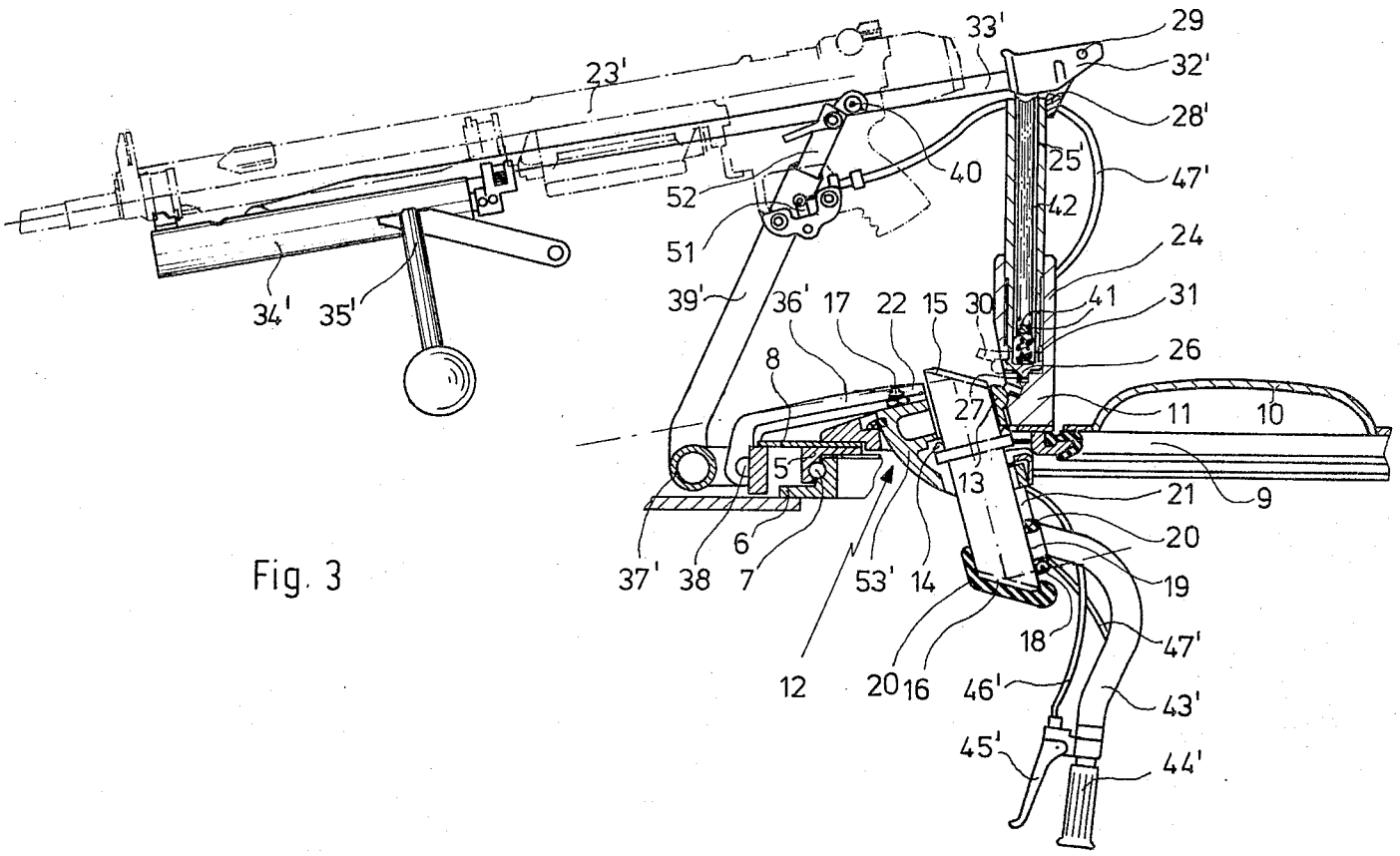
FIG. 3 shows a section taken through another embodiment, with the same section plane as in FIG. 2.

Referring now to the drawings, wherein like reference numerals designate like parts throughout the several views, the gun mount shown therein comprises a lower mount 1 with upper mount 2 attached thereto, as well as aiming means 3, and actuation and setting elements 4, i.e. elevation/depression and traverse setting levers. Lower mount 1 comprises a circular track 5, which is rotatably mounted in a counter track 6 by means of balls 7. The counter track 6 is fixedly attached to the vehicle. The track 5 is covered by a base plate 8, which projects somewhat beyond its diameter. The portion of the base plate 8 located within circular track 5 carries upper mount 2, which is attached thereto. The base plate 8 also has a large opening 9, which can be closed by means of a hatch cover 10, whose hinges are located in that zone of base plate 8 facing away from upper mount 2 as seen in FIG. 3.

Attached to base plate 8 is a support 11, which is designed in the form of a frame. A cylinder blinder 12 is pivotally mounted about a horizontal sight axle 13, which coincides with the cylindrical axis of cylinder blinder 12, i.e. parallel, to the plane of circular track 5. Machined into cylinder blinder 12 is an opening in which the aiming means 3 is inserted from below. A seal 14 is interposed between an annular flange and the cylinder blinder. The aiming means 3 is in the form of a so-called periscope, having two stationary deflecting mirrors 15 and 16. Associated with the upper deflecting mirror 15 is a front sight 17, which is fixedly attached to the upper, radial surface of the cylinder blinder 12. Associated with the lower, inner deflecting mirror 16 is a rear sight 18, which is arranged in front of an eyepiece 19 which, together with the lower end of aiming means 3, is surrounded by a cushion 20. Rear sight 18 is attached to an arm 21 which, in turn, is rigidly attached to cylinder blinder 12. Rear sight 18 can preferably be set for different ranges in a known manner. The arrangement of front sight 17, rear sight 18 and deflecting mirrors 15 and 16 is selected in such a manner that the outer portion of a sight radius 22 is parallel to a sight radius of a mounted weapon 23' seen in FIG. 3.

On the rear of frame support 11, facing away from the muzzle of weapon 23 and facing opening 9, is mounted a tabular sleeve 24, in which a tube 25 is pivotally mounted to rotate about the central axis. The top of tube 25 is open; its lower end surface is provided with a pivot pin 26, which is pivotally mounted in a pivot support 27 of support 11. Attached at the upper end of tube 25 is an arm 28, at whose free end a weapon traverse axle 29, arranged parallel to sight axle 13, is located. Tube 25 is mounted to tube sleeve 24 in an easily detachable manner by means of a rapid-action closure, as for example by means of a lever 30 as shown in FIG. 3. For this purpose, a groove 31, which is engaged by the lever, is machined into tube 25. A weapon support frame 32, to which the rear end of a tubular cradle 33 is rigidly attached, can be pivotally connected about weapon traverse axle 29 to the arm 28. Both ends of the tubular cradle 33 are laterally cranked in such a manner as to avoid any hindrance to the mounting of the weapon 23. Attached to the front end of cradle 33 is a holder 34, which carries the mounting and fixing means by which weapon 23 is releasably secured to the carrier.

In order to ensure the desired relationship between sight radius 22 and weapon 23 in spite of the elevation/depression capability of the weapon as a result of the traverse motion about weapon traverse axle 29, the upper mount 2 is designed as a parallelogram. For this purpose, two arms 36 are rigidly attached to the cylinder blinder 12; the outer ends of the two arms are connected and additionally reinforced one with the other by means of a transverse yoke 37. The arms of the transverse yoke 37 is pivotally connected to the arms 36 about another traverse axle 38, which is parallel to sight axle 13 and weapon traverse axle 29. The traverse axle 38 is arranged at the ends of arms 36 and is immobile relative to arms 36. A connecting rod 39 which is preferably attached directly to transverse yoke 37, e.g. welded on, can thus be pivoted about traverse axle 38. The end of connecting rod 39 is pivotally articulated to carrier tube 33, about an axle 40, which is fixed relative to carrier tube 33 and arranged parallel to axles 13, 29 and 38. The end of connecting rod 39 can be attached to carrier tube 33 in an easily detachable manner; so that after detaching this connection, the connecting rod can be pivoted down about traverse axle 38 to be then generally parallel to arms 36. In this position, the arrangement is employed as a freely aimable gun mount for combatting aircraft, primarily for military use; in which case, aiming means 3 are not employed. The distance between axles 29 and 40 is equal to the distance between axles 38 and 13. Likewise, the distance between axles 38 and 40 is equal to the distance between axles 13 and 29.

In the slightly modified embodiment shown in FIG. 3, all like parts are designated by the same reference numerals, supplemented by an apostrophe. In this embodiment, a tube section 42 is employed to simplify the devices use as a freely aimable gun mount. Tube section 42 is located within tube 25 and is slidable axially under the effect of weight compensation springs 41. The section 42 acts on the weapon support frame 32' at the weapon traverse axle 29 and assumes a portion of the weight of weapon 23' in order to permit the gunner to employ the weapon more easily, and thus more quickly.

Figure 1:
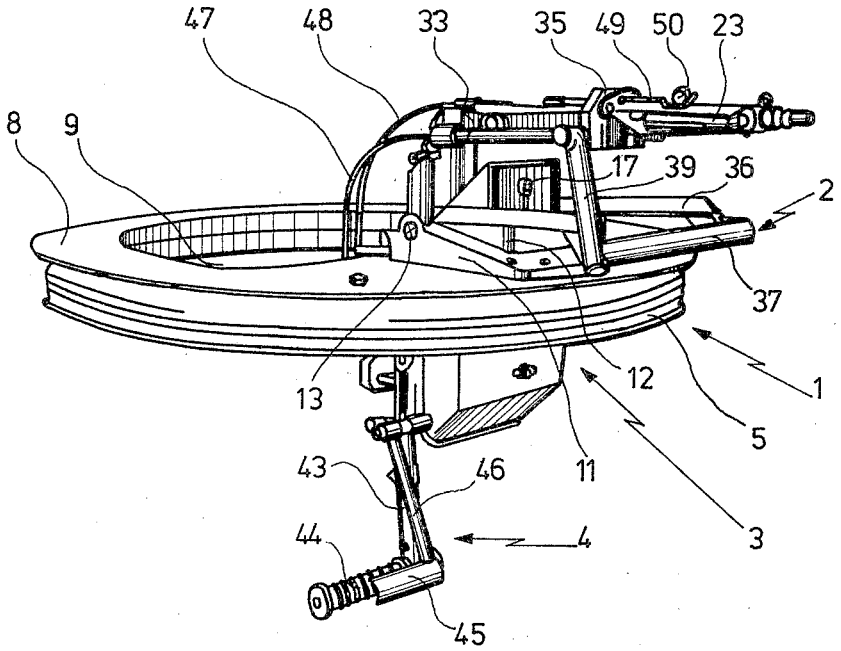
FIG. 1 shows a perspective view of a gun mount, with weapon in place and hatch cover removed, without hood.

Actuation and setting elements 4 comprise, in particular, an elevation/depression setting lever 43. After releasing a lock, the elevation/depression setting lever 43 is swivellable up out of the operating position shown in FIG. 1 so that it does not extend into the interior of the vehicle. Attached to elevation/depression setting lever 43 are a handle 44 and an actuating lever 45. When actuating lever 45 is pulled toward handle 44, an arrestor (not shown) is released, against spring pressure, through conjointly operating means in the form of a linkage 46 or Bowden cable 46', thereby causing cylinder blinder 12, and all parts fixed or attached thereto, to pivot about sight axle 13. It is obvious that the arrestor and cylinder blinder 12 include moving parts, on the one hand, and stationary parts, relative to cylinder blinder 12, on the other, attached to base plate 8 or circular track 5. It is preferably of shoe or disc design.

Figure 2:
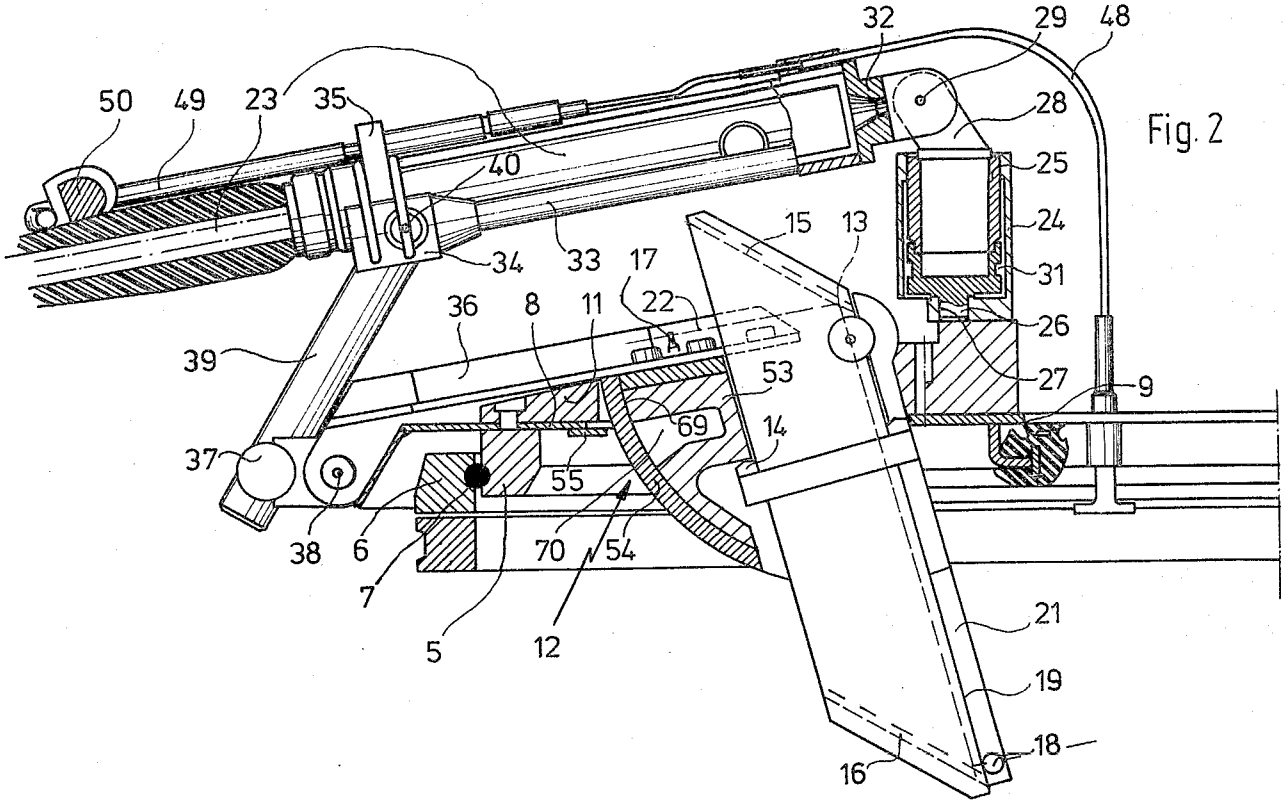
FIG. 2 shows a longitudinal section, with vertical section plane, in which the weapon traverse axle and sight traverse axle are vertical.

Also attached to elevation/depression setting lever 43 is a firing element, which acts on the trigger of the weapon via a Bowden cable 47. The weapon can be cocked for example, by means of a further Bowden cable 48. Bowden cable 48 engages a cocking lever 50 on weapon 23 by means of an actuating hook 49. (Bowden cable 47 is not illustrated in FIG. 2).

Figure 7:
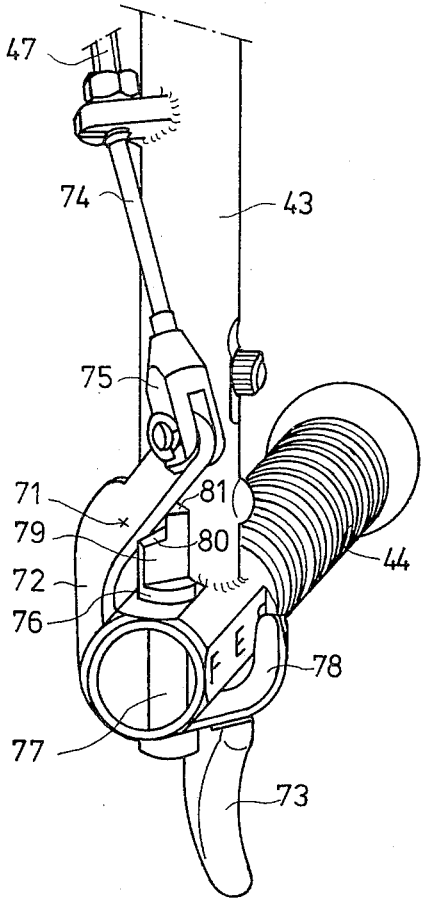
FIG. 7 shows a trigger with adjustable travel limiters.

In FIG. 7, elevation/depression setting lever 43 is illustrated with handle 44, however without actuating lever 45. An axle 71 is attached in the vicinity of the lower end of elevation/depression setting lever 43, generally parallel to handle 44; a lever 72, whose lower end, projecting beyond handle 44, is designed as a trigger 73, is pivoted about axle 71. A core 74 of Bowden cable 47 is articulated to the other end of two-armed lever 72 by means of a fork 75 attached at the end thereof. A safety cylinder 76 can be pivoted about an axle 77 in three stages at the end of handle 44 adjacent to two-armed lever 72. Axle 77 extends generally parallel to the longitudinal direction of elevation/depression setting lever 43, generally at right angles to axle 71, and radially to the longitudinal direction of handle 44. Attached to safety cylinder 76 at the lower end is a selective fire lever 78, which is employed for pivoting safety cylinder 76. At the opposite, upper end of safety cylinder 76, where it is located in the vicinity of the upper arm of lever 72, to which core 74 of Bowden cable 47 is articulated, the safety cylinder is provided with a recess 79, as well as milled surfaces which serve as stop surfaces 80 and 81. By pivoting safety cylinder 76 by means of selective fire lever 78, either stop surfaces 80, 81 or recess 79 can be pivoted into the path of travel of the upper arm of two-armed lever 72. With selective fire lever 78, and thus safety cylinder 76, in the illustrated position, two-armed lever 72 cannot be swivelled in the direction of the trigger, as the upper arm is in a contacting relationship with stop surface 81. If selective fire lever 78, and thus safety cylinder 76, are pivoted into a centre position, stop surface 80 is located in the path of travel of the upper arm of lever 72, and permits a limited degree of motion. If trigger 73 is now pulled, core 74 is moved forward, thereby actuating, in turn, the trigger of weapon 23, thereby causing a shot to be fired. This position of selective fire lever 78 is designated with an "E" on handle 44. Should the gunner wish to fire a burst, it is necessary to pull the trigger of weapon 23 further. In order to permit this, it is first necessary to pivot selective fire lever 78 into the third position, designated with an "F," thereby causing recess 79 of safety cylinder 76 to move into the path of travel of the upper arm of lever 72. This permits lever 72 to be pivoted further, and thus the trigger of weapon 23 to be pulled far enough to reach the burst or sustained automatic fire position. The corresponding position of selective fire lever 78 is designated with an "F" in FIG. 7.

In the embodiment illustrated in FIG. 3, Bowden cable 47' leads to an intermediate lever 51 attached to connecting rod 39'; intermediate lever 51 acts on a trigger 52 of weapon 23', being attached to its trigger assembly housing by means of a rapid-action closure.

Another actuation element, in the form of a traverse setting lever, is not shown in more detail in the drawing. This traverse setting lever is employed for rotating circular track 5, and all parts attached thereto, relative to the vehicle. Also attached to the traverse setting lever is an actuation element for releasing a spring-loaded arrestor, which is attached to circular track 5 and engages parts or surfaces provided on counter track 6 under spring force. For example, the inner, cylindrical surface of the counter ring, which is rigidly attached to the vehicle, can serve as the braking surface, on which the brake elements, attached to the upper, horizontal surface of track 5, act.

In addition, a release element for Bowden cable 47 or 47', which is also not shown in the drawing, is also attached to elevation/depression setting lever 43 and to handle 44; the release element is preferably provided with adjustable stops for limiting the trigger travel in order to be able to pull trigger 52 differing amounts, thereby permitting the sear to actuate only enough to perform the preselected weapon function if appropriate weapons are being employed, e.g. safe, single fire, sustained automatic fire or burst.

In the case of gun mounts on which cocking lever 50 can be actuated by means of Bowden cable 48, the inner actuation end, facing the gunner, can be provided with a releasable lock, permitting the cocking lever to be arrested in the position in which the bolt assembly is drawn to the rear, thereby permitting the weapon to be completely secured against a shot being inadvertantly fired, as it would then be impossible for a shot to be fired, even if the trigger were pulled.

In the embodiment shown in FIG. 3, cylinder blinder 12 comprises a body 53' of armour plate, cast in one piece, which is pivotally mounted, while maintaining narrow gaps in support 11. In the embodiment shown in FIGS. 1 and 2, on the contrary, cylinder blinder 12 comprises an inner body 53, surrounded on the cylindrical surface and ends by a jacket 54 of rolled and heat-treated armour plate. Inner body 53 consists of a material which is not so resistant, for example of aluminium alloy, having a gap 69 between jacket 54 and inner body 53. In addition, chambers 70, opening into the cylindrical surface of inner body 53, are formed in inner body 53. This design provides the advantage that if struck by a bullet, jacket 54 can deform somewhat in the direction of inner body 53, with bulges at the rim of the bullet hole not impairing the mobility of cylinder blinder 12 in the opening of support 11. This largely eliminates jamming or limitation of the elevation/depression range as a result of being struck by bullets. In order to catch lead flowing through the gap between jacket 54 and support 11, a lip 55 is attached in a sufficiently projecting manner, to the vicinity of jacket 54. The lip 55 is of sheet steel and catches the penetrating lead, which flows tangentially to jacket 54 from the point of impact. The lead flows inward since, under the high stress to which it is subjected when striking, it behaves almost like a liquid.

Figure 5:
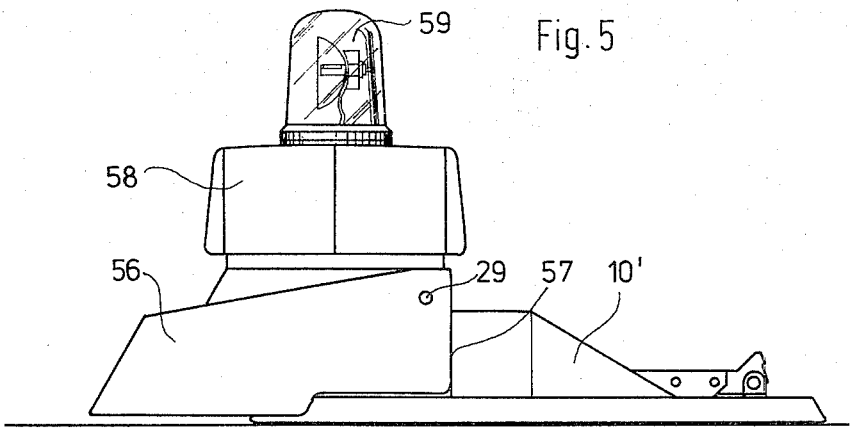
FIGS. 5 and 6 show a side and front view, respectively, with the hood in place and additional accessories attached thereto, on a significantly smaller scale than the other drawings.
Figure 6:
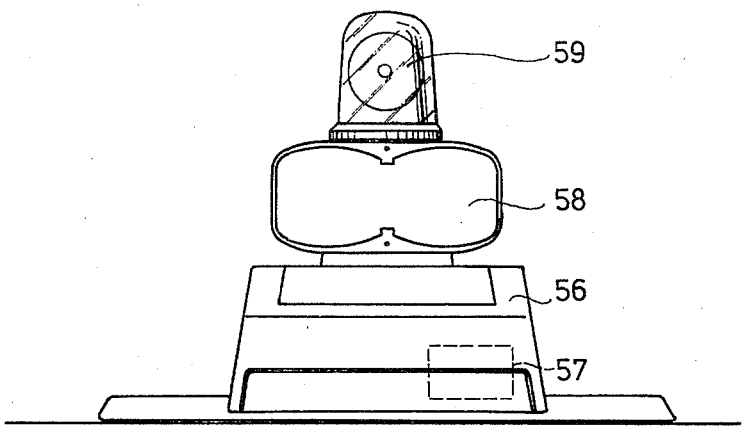

As shown in FIGS. 5 and 6, weapon 23 or 23' can be provided with a hood 56, which can move with the weapon about weapon traverse axle 29, to protect the weapon against the weather, dirt, grapling hooks, stones, etc. when used by the police. Hood 56 also covers the weapon's magazine. For changing the magazine, hatch cover 10 has a trap door 57 on its front side, adjacent to hood 56, through which it is possible for the magazine to be changed while hardly being able to be seen from the outside.

For police service, accessories, such as a loud-speaker 58 or a rotating beacon (flashing police light) 59, for example, can be attached to hood 56. The power supply for these units, as well as any radio communication antenna provided, is in the form of cables run to the inside through hood 56. In order to limit the traverse motion of gun mount 1,2 to $\pm 180°$, plus a supplementary traverse range of approx. 15° to 30°, stop pins 60 are provided on counter track 6 or in another manner so that they are stationary relative to the vehicle. An engageable stop 61 is attached to circular track 5 or to base plate 8. The stop pin 61 includes a latch 64 which can be pivoted about a pin 63 in a holder 62. Latch 64 has two arc-shaped stop surfaces 65 at its two opposite ends, as well as an outwardly projecting cam 66 therebetween, arranged radially to the rotational axis of circular track 5. When the circular track 5 is rotated, stop pins 60 protrude into the path of travel of the stop pin 61 when latch 64 is located in its centre engagement attitude, illustrated by dashed lines in FIG. 4. The engagement is produced by means of rounded depressions 67 machined into the side of latch 64 opposite cam 66. The depressions 67 engage a spring-loaded pin 69, which is mounted and guided radially to pin 63 in a bore in holder 62.

Figure 4:
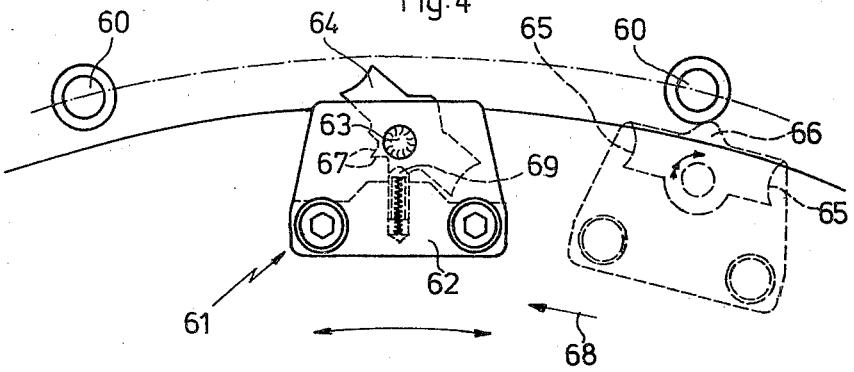
FIG. 4 shows the traverse limitation and engagement means of the circular track.

If stop 61 is located outside the range of stop pins 60, latch 64 assumes the centre position, illustrated by dashed lines in FIG. 4. If circular track 5 is now traversed far enough in the direction of an arrow 68 that stop 61 passes the first stop pin 60, cam 66 cams against stop pin 60, swivelling latch 64 into the position illustrated by the solid lines in FIG. 4, in which one of the two arc-shaped stop surfaces 65 is facing the next stop pin 60 in the direction of arrow 68. Absolute termination of the traverse motion is achieved when stop surface 65 comes into a contacting relationship with the second stop pin 60. When traversed back, the front stop pin 60 comes into a contacting relationship with the surface adjacent to cam 66, thereby swivelling latch 64 back into the position illustrated by the dashed lines. On the opposite side, i.e. after having traversed almost 360°, limitation is performed in the same manner, with only the functions of stop pins 60 being reversed. Thus, a total of two stop pins 60 is sufficient if free traverse (before contacting the first stop pin 60) of two times 160° to 170° is desired, with limitation being provided after two times 190° to 200°.

The illustrated gun mount can be employed as a universal gun mount, for both police and military service, and can be employed as both an overhead and freely aimable gun mount. A particular advantage is the fact that the gunner can work with the sights to which he is normally accustomed when firing the weapon, as mechanical front and rear sights, designed in the same manner as the sights in the weapon, can be employed. In addition, the sight radius between front and rear sight on the weapon can be dimensioned in the same manner as on the gun mount. The fixed base of axle parallelogram 13, 29, 38, 40 are axles 13 and 29, about which the two other axles move in a corresponding manner, with the axis of the weapon and the sight radius being aligned in such a manner that they are matched one to the other. The periscope with fixed mirrors represents economical and rugged aiming means, providing a good view of the battlefield. All operations, such as aiming, disengaging the safety, single fire, automatic fire and cocking, preferably for combatting ground targets, can be performed behind the protection of the armour plate, with hatch cover 10 closed. In order to be able to effectively combat air targets, preferably for military service, hatch cover 10 is opened, with the rapid-action closures on axle 40, as well as on trigger 52 and cocking lever 50, being released, thereby permitting the gunner to fire at both air and ground targets, without any restriction. An anti-aircraft sight, which comes with the weapon, is preferably employed for firing at air targets. To accomplish this, the arrestor of the circular track 5 is released and fixed in the released position. Then, the upper mount is locked in tube sleeve 24 and is only vertically pivoted. However it is better for the circular track to be arrested and not remain released. In this case, the upper mount can be pivoted freely about the vertical axis at tube sleeve 24, thereby permitting the weapon to be easily fired from the hatch in a traverse range of approx. 150°, in only one position of the circular track. Should a greater traverse range be required, the gun mount is rotated appropriately in the vehicle and then arrested again. With this operating mode, the hit accuracy is higher than with the previously described operating mode.

Obviously, many modifications and variations of the present invention are possible in the light of the above teachings. It should therefore be understood that within the scope of the appended claims, the invention may be practiced otherwise than as specifically described. In particular, it is obvious that upper mount 2 can include differently designed support frames 32, carrier tubes 33 and holders 34 with fixing means 35 and connecting rods 39, matched to different weapons 23.

Having thus fully disclosed our invention, what we claim is:

1. A gun mount for light automatic weapons, comprising an upper mount having cradle means for the detachable attachment of the weapon thereto, and having a lower mount having a circular track and being adapted to be attached to a vehicle in such a manner that the upper mount can be rotated about the vertical axis of the circular track together with the weapon, said cradle being pivotable about a horizontal weapon traverse axis aiming means comprising a rigid periscope having fixed reflecting mirrors, whose eyepiece is located below the circular track and whose sight radius is coupled with the traverse motion of the weapon about the weapon traverse axis said aiming means being pivotable about a sight axis which is parallel to the horizontal weapon traverse axis and attached to a blinder having surface areas which are rotationally symmetrical to the sight axis, a connecting rod having one end pivotable about a first traverse axle parallel to the sight axis and rigidly connected to the blinder and the other end articulated about a second traverse axle on said cradle said sight axis, said weapon traverse axis, said first traverse axle and said second traverse axle forming the corners of a parallelogram.

2. The gun mount set forth in claim 1, in which at least one end of the connecting rod is attached in an easily detachable manner, and the upper mount is arranged eccentrically to the circular track and is equipped with a hatch within the circular track.

3. The gun mount set forth in claim 1, in which the blinder is designed as a cylinder blinder and has the configuration of a cylinder segment.

4. The gun mount set forth in claim 1, in which a rear sight is attached in the aiming means in front of the eyepiece and a front sight in front of the other end of the aiming means.

5. The gun mount set forth in claim 4, in which the rear sight is adjustable and can be set for different ranges.

6. The gun mount set forth in claim 1, in which the aiming means can be removed from the blinder from the interior of the vehicle.

7. The gun mount set forth in claim 3, in which in its lowest position, the cylinder blinder is generally flush with the surface of the lower mount.

8. The gun mount set forth in claim 3 in which the cylinder blinder has an inner body of aluminum alloy and a jacket, as well as end plates if desired, of rolled armour plate.

9. The gun mount set forth in claim 8, in which the jacket is arranged at a distance from the inner body and/or those surfaces of the inner body facing the jacket preferably have pocket like depressions or chambers.

10. The gun mount set forth in claim 1 for a weapon whose functions, such as engaging the safety, single fire, bursts or sustained automatic fire, can be set by means of the length of trigger travel, in which the remote trigger is equipped with adjustable travel limiters.

11. The gun mount set forth in claim 1, in which accessories for police service are attached to the upper mount.

12. The gun mount set forth in claim 11, in which the accessories are attached to a protective or cover hood, with power being supplied to them from the interior of the vehicle by means of cables extending therethrough.

13. The gun mount set forth in claim 12, in which the cables are run around the circular track, with one stop each being provided for limiting the rotation of the circular track, thereby producing limitation of more than approx. 180°.

14. The gun mount set forth in claim 13, in which the stop is attached to the circular track and acts conjointly with stationary stop pins.

15. The gun mount set forth in claim 14, in which the stop has three engagement positions and is able to be pivoted by a first stop pin into an outer engagement position, in which it acts conjointly with the second stop pin in a limiting manner, while being able to be pivoted back into the centre engagement position again by the first stop pin when travelling backward.

16. The gun mount set forth in claim 12, in which the hood is equipped with a trap door, capable of being operated from the inside, through which the weapon can be operated and, in particular, the weapon's magazine can be changed.

17. The gun mount according to claim 1 including elevation/depression and traverse setting levers, connected in a conjointly operating manner with the circular track and cradle, said levers being arranged beneath said circular track and having remote control means for operating the trigger of said weapon.

* * * * *